US009114618B2

(12) United States Patent
Murayama et al.

(10) Patent No.: US 9,114,618 B2
(45) Date of Patent: Aug. 25, 2015

(54) LIQUID EJECTING APPARATUS AND MAINTENANCE METHOD

(71) Applicant: SEIKO EPSON CORPORATION, Tokyo (JP)

(72) Inventors: Masato Murayama, Matsumoto (JP); Tomohiro Sayama, Matsumoto (JP); Yoshihiro Watanabe, Shiojiri (JP); Masashi Kamibayashi, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/132,605

(22) Filed: Dec. 18, 2013

(65) Prior Publication Data

US 2014/0198156 A1 Jul. 17, 2014

(30) Foreign Application Priority Data

Jan. 11, 2013 (JP) ..... 2013-003671

(51) Int. Cl.
*B41J 2/165* (2006.01)

(52) U.S. Cl.
CPC ..... *B41J 2/16544* (2013.01)

(58) Field of Classification Search
CPC ..... B41J 2/16544; B41J 2/16535; B41J 2/16547; B41J 12/16538; B41J 2/16523; B41J 2/16541; B41J 2002/16502
USPC ..... 347/33
See application file for complete search history.

(56) References Cited

U.S. PATENT DOCUMENTS 6,631,975 B2 * 10/2003 Fukasawa et al. ..... 347/33
2013/0120496 A1 * 5/2013 Nakamura et al. ..... 347/33

FOREIGN PATENT DOCUMENTS

JP 2001-260368 9/2001
JP 2007-130807 5/2007
JP 2009-292108 12/2009

* cited by examiner

*Primary Examiner* — Jannelle M Lebron
(74) *Attorney, Agent, or Firm* — Workman Nydegger

(57) ABSTRACT

A liquid ejecting apparatus includes a liquid ejecting head that ejects a liquid from a nozzle toward a target which is positioned away from a nozzle forming surface where the nozzle is formed; a wiping member that is capable of wiping the nozzle forming surface; a movement mechanism that relatively moves the liquid ejecting head and the wiping member when wiping is carried out; and a control portion that controls the movement mechanism so as to cause a relative moving velocity between the liquid ejecting head and the wiping member to be lower when wiping is carried out in a case where the liquid is ejected at a second distance of which an opposing distance between the nozzle forming surface and the target is longer than a first distance compared to a case where the liquid is ejected at the first distance of the opposing distance.

6 Claims, 9 Drawing Sheets

LIQUID EJECTING APPARATUS AND MAINTENANCE METHOD

BACKGROUND

1. Technical Field

The present invention relates to a liquid ejecting apparatus such as an ink jet-type printer and a maintenance method of the same liquid ejecting apparatus.

2. Related Art

Hitherto, an ink jet-type printer has been known as a type of liquid ejecting apparatus, which ejects a liquid from a nozzle of a liquid ejecting head onto a target such as paper so as to print an image and the like. In the aforementioned printers, there is a printer provided with a wiper unit (cleaning mechanism) that removes an unnecessary ink which adheres to a nozzle forming surface of the liquid ejecting head in order to preferably maintain a liquid ejection characteristic of the liquid ejecting head (for example, JP-A-2001-260368).

The wiper unit carries out wiping in which a wiping member (fabric tape) that is capable of absorbing an ink slides on the nozzle forming surface of the liquid ejecting head, thereby wiping out the ink from the nozzle forming surface.

Incidentally, a wiping member in a wiper unit is made of a fabric woven from polyester fibers and the like, and is capable of absorbing an ink by confining the ink in a gap between the fabrics.

Therefore, when wiping is carried out on a nozzle forming surface where a large amount of ink adheres and during the wiping, there is a possibility that a slide section of the wiping member which slides on the nozzle forming surface may be in a state where the ink is absorbed to the saturation point. In this case, the slide section of the wiping member which is in the state where the ink is absorbed to the saturation point slides on the nozzle forming surface of a liquid ejecting head, and the slide section pushes the ink or a foreign substance in the ink that adheres to the nozzle forming surface into a nozzle, thereby causing a disadvantage in maintaining an ink ejection characteristic in a favorable manner.

The above-described circumstance is generally common in liquid ejecting apparatuses that carry out a maintenance of wiping out a liquid which adheres to the nozzle forming surface where the nozzle is formed using a wiping member that is capable of absorbing the liquid.

SUMMARY

An advantage of some aspects of the present invention is to provide a liquid ejecting apparatus and a maintenance method of the liquid ejecting apparatus in which a liquid can be wiped out regardless of an amount of the liquid that adheres to a nozzle forming surface of a liquid ejecting head such that a liquid ejection characteristic can be favorably maintained.

Hereinafter, means of the invention and operation effects thereof will be described.

According to an aspect of the present invention, there is provided the liquid ejecting apparatus including a liquid ejecting head that ejects a liquid from a nozzle toward a target which is positioned away from a nozzle forming surface where the nozzle is formed, a wiping member that is capable of wiping the nozzle forming surface, a movement mechanism that relatively moves the liquid ejecting head and the wiping member when wiping is carried out, and a control portion that controls the movement mechanism so as to cause a relative moving velocity between the liquid ejecting head and the wiping member to be lower when wiping is carried out in a case where the liquid is ejected at a second distance of which an opposing distance between the nozzle forming surface and the target is longer than a first distance compared to a case where the liquid is ejected at the first distance of the opposing distance.

When the liquid is ejected from the nozzle of the liquid ejecting head toward the target, a portion of the ejected liquid sometimes becomes a mist floating between the nozzle forming surface and the target without landing on the target. If the mist (liquid) adheres to the nozzle forming surface of the liquid ejecting head, a liquid ejection characteristic of the liquid ejecting head is affected. Therefore, when the liquid adheres to the nozzle forming surface, wiping is carried out to wipe out the liquid from the nozzle forming surface.

Meanwhile, an amount of the mist (amount of liquid) that adheres to the nozzle forming surface tends to be increased in a case where the opposing distance between the nozzle forming surface and the target is long when ejecting the liquid compared to a case where the opposing distance is short. Therefore, when wiping is carried out after the liquid is ejected at the second distance of which the opposing distance is relatively long in the same aspect of wiping that is carried out after the liquid is ejected at the first distance of which the opposing distance is relatively short, there is a possibility that a liquid absorption capacity of a slide section of the wiping member which slides on the nozzle forming surface may be saturated. If the slide section of which the liquid absorption capacity is saturated slides on the nozzle forming surface, it is unlikely that the ink which adheres to the nozzle forming surface is normally removed, thereby causing a possibility that the favorable ejection characteristic of the liquid ejecting head cannot be maintained.

In this respect, according to the above-referenced configuration, the relative moving velocity between the liquid ejecting head and the wiping member is lower when wiping is carried out in a case where the opposing distance is long at the time of a liquid ejection compared to a case where the opposing distance is short. That is, the relative moving velocity (sliding velocity) between the nozzle forming surface and the wiping member is lower when wiping is carried out in a case where an amount of the liquid that adheres to the nozzle forming surface of the liquid ejecting head is expected to be large compared to a case where the amount is expected to be small.

Therefore, even though a large amount of the liquid adheres to the nozzle forming surface of the liquid ejecting head, the liquid that is absorbed from the nozzle forming surface likely spreads in the wiping member from the slide section with respect to the nozzle forming surface to non-slide sections. That is, even though an amount of the liquid that adheres to the nozzle forming surface is large, it is possible to suppress the wiping member that pushes the liquid or a foreign substance in the liquid into the nozzles when wiping is carried out. Accordingly, it is possible to wipe out the liquid regardless of the amount of the liquid that adheres to the nozzle forming surface of the liquid ejecting head so that the liquid ejection characteristic can be preferably maintained.

In addition, it is preferable that the liquid ejecting apparatus further include a wiper cassette that holds the wiping member. It is preferable that the wiping member be formed in a long shape to be configured to move relatively with the liquid ejecting head in a state of being held by the wiper cassette. It is preferable that the wiper cassette rotatably support a first roller that winds an end of the wiping member in the longitudinal direction, a second roller that winds the other end of the wiping member in the longitudinal direction, and a third roller that presses the wiping member against the nozzle forming surface. It is preferable that the control portion rotate the second roller in a winding direction to cause the wiping member to be wound from the first roller to the second roller when wiping is carried out in a case where the liquid is ejected at a third distance of which the opposing distance is longer than the first distance.

According to the above-referenced configuration, if the third distance of which the opposing distance is longer than the first distance when ejecting the liquid, that is, if an amount of the liquid that adheres to the nozzle forming surface is expected to be large, a sliding area of the wiping member on the nozzle forming surface can be widened by winding the wiping member when wiping is carried out. Therefore, when the liquid is ejected at a long opposing distance to cause the large amount of the liquid to adhere to the nozzle forming surface, the liquid is appropriately wiped out so that the liquid ejection characteristic can be preferably maintained.

In addition, in the liquid ejecting apparatus, it is preferable that the control portion cause a winding amount of the wiping member to be increased when wiping is carried out in a case where the liquid is ejected at a fourth distance of which the opposing distance is longer than a third distance compared to a case where the liquid is ejected at the third distance of the opposing distance.

According to the above-referenced configuration, if the fourth distance of which the opposing distance is longer than the third distance when ejecting the liquid, that is, if an amount of the liquid that adheres to the nozzle forming surface is expected to be larger, a sliding area of the wiping member on the nozzle forming surface can be further widened by increasing the winding amount of the wiping member when wiping is carried out. Therefore, when the liquid is ejected at a longer opposing distance to cause the larger amount of the liquid to adhere to the nozzle forming surface, the liquid is further appropriately wiped out so that the liquid ejection characteristic can be preferably maintained.

In addition, in the liquid ejecting apparatus, when wiping is carried out, it is preferable that a moving direction in which the slide section of the wiping member that moves on the nozzle forming surface moves in accordance with the winding of the wiping member be equal to a relative moving direction of the liquid ejecting head with respect to the wiper cassette.

According to the above-referenced configuration, the moving direction in which the slide section of the wiping member moves in accordance with the winding of the wiping member is the same direction as the relative moving direction of the liquid ejecting head with respect to the wiper cassette. Therefore, compared to a case where the moving direction is a reversed direction, it is possible to reduce a friction force that is generated by sliding of the wiping member to be applied to the nozzle forming surface.

According to another aspect of the invention, there is provided a maintenance method of a liquid ejecting apparatus wiping out a liquid from the nozzle forming surface by relatively moving a wiping member capable of wiping the nozzle forming surface and the liquid ejecting head after the liquid is ejected from a nozzle toward a target that is positioned away from the nozzle forming surface where the nozzle is formed in the liquid ejecting head. Furthermore, the maintenance method including causing a relative moving velocity between the liquid ejecting head and the wiping member to be lower when wiping is carried out in a case where the liquid is ejected at a second distance of which an opposing distance between the nozzle forming surface and the target is longer than the first distance compared to a case where the liquid is ejected at the first distance of the opposing distance.

According to the above-referenced configuration, it is possible to achieve operation effects similar to the operation effects of the above-described liquid ejecting apparatus.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Hereinafter, a first embodiment in which a liquid ejecting apparatus is embodied in an ink jet-type printer will be described with reference to drawings.

Figure 1:
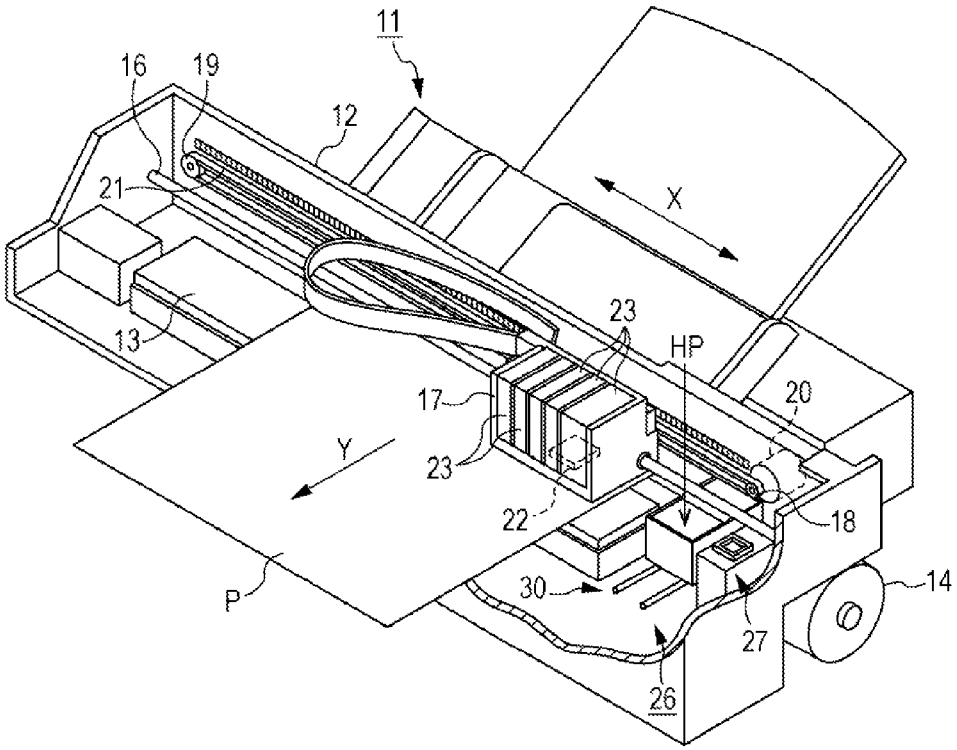
FIG. 1 is a perspective view of a printer according to a first embodiment.

As illustrated in FIG. 1, in a printer 11, a substantially square plate-shaped support member 13 is disposed in a lower inside portion of a frame 12 that forms a substantially rectangular case shape of which upper side is open, and in the longitudinal direction as a main scanning direction X. A recording medium P as an example of a target is transported on the support member 13 in a transportation direction Y that is orthogonal to the main scanning direction X while being held between a pair of a feeding roller and a transporting roller (neither illustrated) that are driven by a power of a transportation motor 14 which is provided in a lower rear side portion of the frame 12. In addition, a guide axis 16 that is installed above the support member 13 in a state parallel to the longitudinal direction of the support member supports a carriage 17 that is in a reciprocally movable state in an axis direction of the guide axis.

The frame 12 supports a drive pulley 18 and a driven pulley 19 at both positions in the vicinity of both end portions of the guide axis 16 in a rotatable state. The drive pulley 18 is connected to an output axis of a carriage motor 20 which supplies a power source to the carriage 17 for reciprocal movements. In addition, an endless belt-shaped timing belt 21 of which a portion is connected to the carriage 17 is hung between the pair of pulleys 18 and 19. Therefore, the carriage 17 is reciprocally movable in the main scanning direction X while being guided by the guide axis 16 in accordance with a normal rotation and a reverse rotation of the timing belt 21 that is powered by the carriage motor 20.

A liquid ejecting head 22 is provided under the carriage 17. Meanwhile, a plurality of (five in this embodiment) ink cartridges 23 storing inks (liquid) that are supplied to the liquid ejecting head 22 are mounted on the carriage 17 in an attachable and detachable manner.

Figure 2:
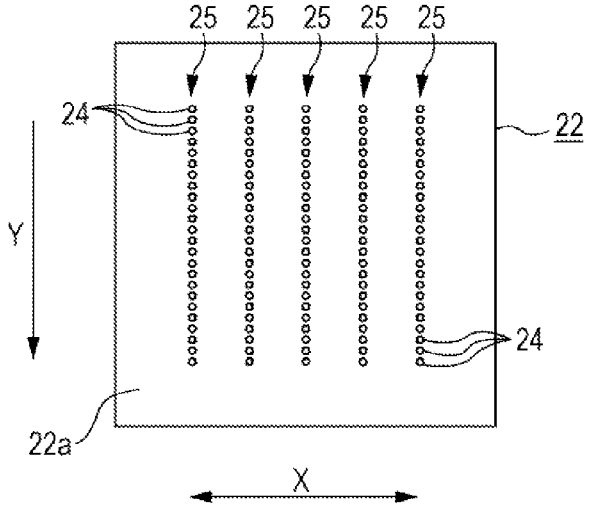
FIG. 2 is a schematic diagram illustrating a schematic configuration of a nozzle forming surface according to the first embodiment.

As illustrated in FIG. 2, in a nozzle forming surface 22*a* that faces the support member 13 of the liquid ejecting head 22, a plurality of nozzles 24 that respectively correspond to each of the ink cartridges 23 form nozzle rows 25 along the transportation direction Y to be juxtaposed at regular intervals in the main scanning direction X. An ink droplet is ejected from the nozzles 24 of the liquid ejecting head 22 onto the recording medium P that is fed to the support member 13, thereby recording an image and the like on the recording medium P. The recording medium P that is a subject of printing by the printer 11 of the present embodiment is, for example, a sheet of paper, a fabric, a film and the like. In addition, the printer 11 is capable of printing with respect to the recording medium P having different thicknesses.

As illustrated in FIG. 1, five ink cartridges 23 respectively contain the inks in colors of, for example, cyan, magenta, yellow, black and white. The liquid ejecting head 22 ejects the inks that are supplied from each of the ink cartridges 23, and thus, it is possible to carry out color printing or the like. A method of installing the ink cartridges 23 is not limited to a so-called on-carriage type in which the ink cartridges 23 are mounted on the carriage 17. The method may be a so-called off-carriage type in which the ink cartridges 23 are installed in a cartridge holder at a main body side of the printer in an attachable and detachable manner.

In addition, as illustrated in FIG. 1, inside the frame 12, a maintenance device 26 for carrying out maintenance of the liquid ejecting head 22 is provided in a lower side of a home position HP where the carriage 17 stands by during a non-printing state. The maintenance device 26 includes a cap unit 27 that abuts on the nozzle forming surface of the liquid ejecting head 22 to suppress evaporation of an ink solvent from the nozzle 24 during the non-printing state and that sucks in the ink being thickened from the nozzle 24. The maintenance device also includes a wiper unit 30 that is capable of wiping out the ink which adheres to the nozzle forming surface 22*a* of the liquid ejecting head 22.

Next, the wiper unit 30 will be described with reference to FIG. 3.

Figure 3:
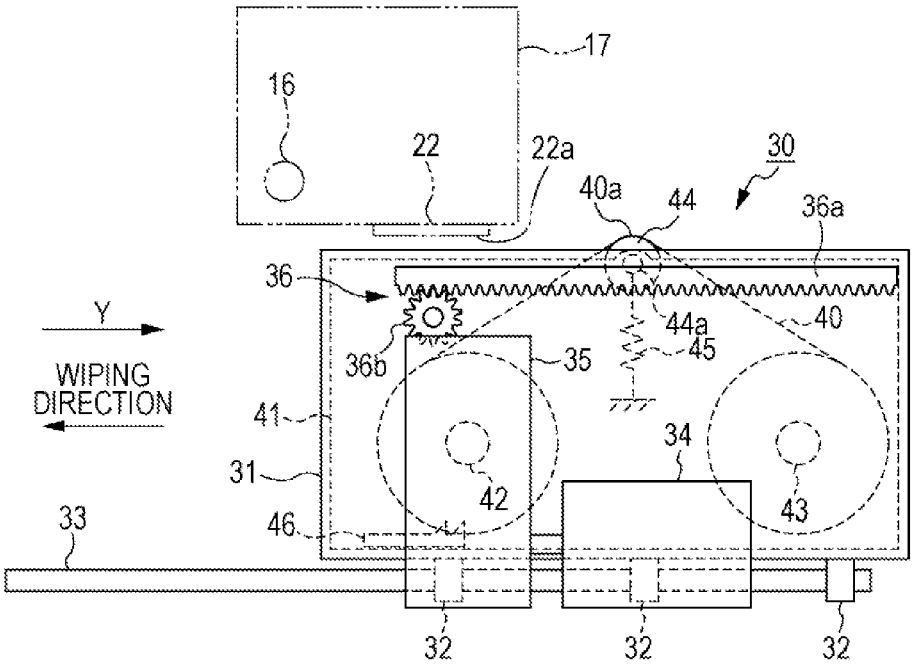
FIG. 3 is a side view illustrating a schematic configuration of a wiper unit according to the first embodiment.

As illustrated in FIG. 3, the wiper unit 30 includes a wiper holder 31 that is movable in a wiping direction when wiping out the ink which adheres to the nozzle forming surface 22*a*. The wiper unit includes a wiper cassette 41 that is installed in the wiper holder 31 in an attachable and detachable manner. A long wiping member 40 that is capable of absorbing the ink which adheres to the nozzle forming surface 22*a* is mounted on the wiper cassette 41.

As illustrated in FIG. 3, the longitudinal direction of the wiper holder 31 is the transportation direction Y of the recording medium P. The wiper holder is reciprocally movable in the transportation direction Y via an engagement between a guide portion 32 that is fixed to a lower portion of the wiper holder and a rail portion 33 that extends in the transportation direction Y. In addition, a drive motor 34 that supplies a power source to the wiper holder 31 for the reciprocal movements and a power transmission mechanism 35 that transmits the power source of the drive motor 34 are provided in the frame 12 at the main body side of the printer 11.

A rack-and-pinion mechanism 36 is provided on a side portion of the wiper holder 31. The rack-and-pinion mechanism 36 has a rack 36*a* that is fixed on a side surface of the wiper holder 31 and extends in the wiping direction. The rack-and-pinion mechanism has a pinion 36*b* that engages with the rack 36*a* and rotates by a power transmitted via the power transmission mechanism 35. In this manner, the wiper holder 31 is capable of moving from a wiping start position located on one end side (right side in FIG. 3) of the rail portion 33 to a wiping end position located on the other end side (left side in FIG. 3) of the rail portion 33, and moving from the wiping end position to the wiping start position. Therefore, in the embodiment, there is configured a "movement mechanism" that relatively moves the liquid ejecting head 22 and the wiping member 40 when wiping is carried out through the drive motor 34, the power transmission mechanism 35 and the rack-and-pinion mechanism 36.

As illustrated in FIG. 3, a feeding roller 42 as an example of a first roller and a winding roller 43 as an example of a second roller are rotatably supported by the wiper cassettes 41 in a state of being apart by a predetermined distance in the wiping direction. One end of the wiping member 40 in the longitudinal direction is wound to the feeding roller 42, and the other end of the wiping member 40 in the longitudinal direction is wound to the winding roller 43.

In addition, the wiping member 40 that is hung between both the rollers 42 and 43 is wound to a pressing roller 44. The pressing roller is an example of a third roller in a state of protruding partially from an opening (not illustrated) in an upper center portion of the wiper cassette 41. Here, a section wound to the pressing roller 44 of the wiping member 40 is a primary absorption section 40*a* absorbing the ink that adheres to the nozzle forming surface 22*a* by relatively moving (hereinafter, also referred to as "sliding") in a state of being in contact with the nozzle forming surface 22*a* when wiping is carried out. In addition, a support axis 44*a* that pivotally supports the pressing roller 44 is biased upward by a compression spring 45 such that the primary absorption section 40*a* is in a state of being biased upward.

In addition, the feeding roller 42 of the wiper cassette 41 is provided with a ratchet 46 that allows the feeding roller 42 to rotate in a feeding direction when winding the wiping member 40 to the winding roller 43 while regulating the feeding roller 42 not to rotate in the feeding direction when not winding the wiping member to the winding roller. When winding the wiping member 40 to the winding roller 43, both of the feeding direction in which the feeding roller 42 rotates and a winding direction in which the winding roller 43 rotates are clockwise directions in FIG. 3.

In the embodiment, in the wiper cassette 41 being installed in the wiper holder 31, axis line directions in the respective rollers 42, 43 and 44 which are pivotally supported by the wiper cassette 41 are the main scanning direction X. In addition, a relative moving direction (wiping direction) of the liquid ejecting head 22 and the wiping member 40 when wiping is carried out is a direction along forming directions of in the respective nozzle rows 25 of the liquid ejecting head 22.

Next, referring to FIG. 4, an electric configuration related to controlling of the wiper unit 30 will be described.

Figure 4:
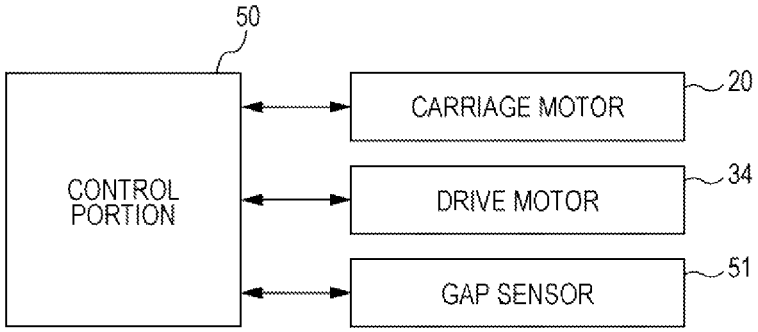
FIG. 4 is a block diagram illustrating an electric configuration according to the wiper unit according to the first embodiment.

As illustrated in FIG. 4, the printer 11 includes a control portion 50 that manages a maintenance control and the like of the liquid ejecting head 22. An input/output interface of the control portion 50 is electrically connected to the carriage motor 20 and the drive motor 34. In addition, the input/output interface of the control portion 50 is electrically connected to a gap sensor 51 detecting a gap PG (opposing distance) from the nozzle forming surface 22*a* of the liquid ejecting head 22 to a surface of the recording medium P that is supported on the support member 13. The control portion 50 is capable of controlling driving of the carriage motor 20, the drive motor 34 and the like in accordance with a degree of the gap PG that is detected by the gap sensor 51.

Figure 5:
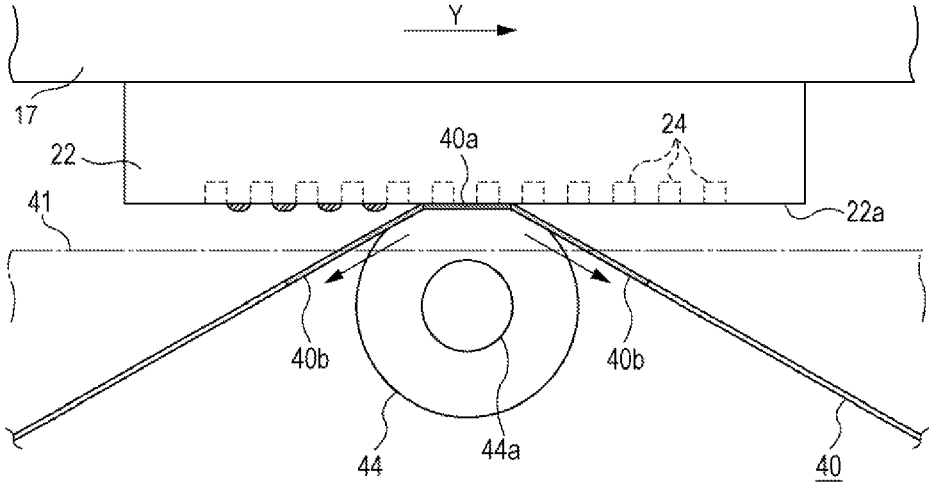
FIG. 5 is a schematic diagram describing an appearance of a wiping member absorbing an ink.

Next, referring to FIG. 5, an aspect of absorbing the ink by the wiping member 40 will be described. FIG. 5 illustrates an appearance of wiping in a process.

The wiper unit 30 in the embodiment causes the wiping member 40 made of a non-woven fabric such as a synthetic resin to slide on the nozzle forming surface 22*a* so as to absorb the ink that adheres to the nozzle forming surface 22*a* into a gap (void) between the fibers of the synthetic resins, thereby eliminating the ink.

As illustrated in FIG. 5, the ink absorbed by the wiping member 40 from the nozzle forming surface 22*a* is firstly absorbed into the primary absorption section 40*a* that slides on the nozzle forming surface 22*a*. Subsequently, the ink absorbed into the primary absorption section 40*a* spreads to secondary absorption sections 40*b* that are positioned on a feeding upstream side and a winding downstream side of the primary absorption section 40*a* (wiping member 40). That is, the wiping member 40 spreads the ink absorbed into the primary absorption section 40*a* to the secondary absorption sections 40*b* so that the primary absorption section 40*a* is capable of absorbing more ink than an amount that can be absorbed by the primary absorption section 40*a* that slides on the nozzle forming surface 22*a*, that is, the primary absorption section 40*a* is capable of absorbing more ink than an amount that can be absorbed by the void in the primary absorption section 40*a*.

Therefore, when an amount of the ink that adheres to the nozzle forming surface 22*a* is less than an amount of the ink which can be absorbed by the primary absorption section 40*a*, even though the wiping member 40 is caused to slide on the nozzle forming surface 22*a* at a higher velocity than a spreading velocity of the ink from the primary absorption section 40*a* to the secondary absorption sections 40*b*, it is highly likely to remove the ink that adheres to the nozzle forming surface 22*a*. Meanwhile, when the amount of the ink that adheres to the nozzle forming surface 22*a* is more than the amount of the ink which can be absorbed by the primary absorption section 40*a*, if the wiping member 40 is caused to slide on the nozzle forming surface 22*a* at the higher velocity than the spreading velocity of the ink from the primary absorption section 40*a* to the secondary absorption sections 40*b*, it is highly unlikely to remove the ink that adheres to the nozzle forming surface 22*a*. Furthermore, in this case, the primary absorption section 40*a* sliding on the nozzle forming surface 22*a* in a state where the ink is absorbed to the saturation point may push the ink that adheres to the nozzle forming surface 22*a* or air bubbles into the nozzles 24, thereby causing a possibility of deterioration in an ink ejection characteristic of the liquid ejecting head 22.

Therefore, when the amount of the ink that adheres to the nozzle forming surface 22*a* is large, there is a need to facilitate the ink to spread to the secondary absorption sections 40*b* by lowering a sliding velocity VW of the wiping member 40. Otherwise, there is a need for the primary absorption section 40*a* in the wiping member 40 which slides on the nozzle forming surface 22*a* when wiping is carried out to be in a state where the ink is yet to be absorbed by winding the primary absorption section 40*a* (wiping member 40) in the state where the ink is absorbed to the saturation point to the winding roller 43.

Next, a description for determining whether the amount of the ink that adheres to the nozzle forming surface 22*a* is small or large will be given.

In a ink jet-type printer such as the printer 11 of the embodiment which carries out printing by ejecting the ink from the liquid ejecting head 22 toward the printing medium P, a slight portion of the ink that is ejected toward the recording medium P is misted, thereby sometimes floating as an ink mist between the nozzle forming surface 22*a* and the recording medium P. An atmospheric current generated by the reciprocal movements of the carriage 17 in the main scanning direction X or ejecting of the ink sometimes causes the ink mist to adhere to the nozzle forming surface 22*a* of the liquid ejecting head 22. A phenomenon in which a portion of the ejected ink is misted and floats as the ink mist is caused due to a reaction force such as air resistance acting in a reverse direction of an ejecting direction with respect to the ink that is ejected toward the recording medium P.

In addition, in the printer 11 of the embodiment, the recording medium P in different types and the recording medium P having different thicknesses are printing subjects. If the recording medium P differs in types or thicknesses, the opposing distance between the nozzle forming surface 22*a* and the surface of the recording medium P disposed on the support member 13 when ejecting the ink from the liquid ejecting head 22, that is, the gap PG is appropriately changed, thereby being able to carry out printing suitable for each recording medium P.

Figure 6A:
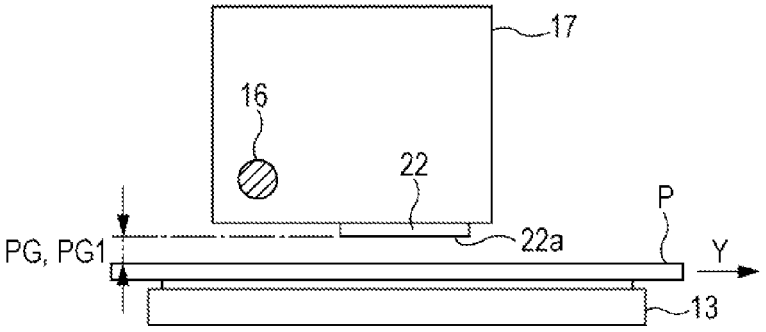
FIGS. 6A and 6B are schematic diagrams describing different states of gaps.
Figure 6B:
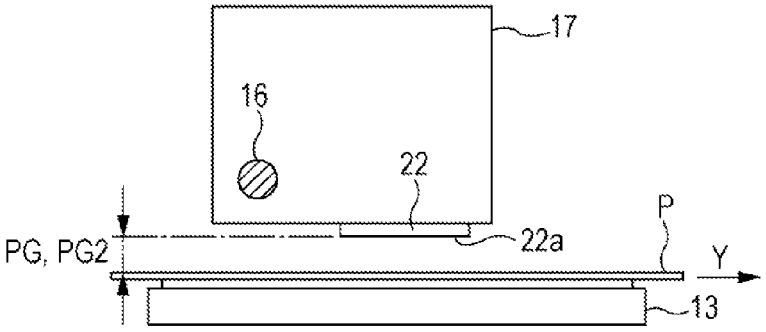

As illustrated in FIG. 6A, if the gap PG is comparatively small when ejecting the ink onto the recording medium P that is supported by the support member 13 (for example, in case of gap PG1), the ink ejected from the liquid ejecting head 22 is unlikely to be influenced by the air resistance and the like so that an amount of the generated ink mist is small. Meanwhile, as illustrated in FIG. 6B, if the gap PG is comparatively large when ejecting the ink (for example, in case of gap PG2), the ink ejected from the liquid ejecting head 22 is likely to be influenced by the air resistance and the like so that an amount of the generated ink mist is increased. In FIGS. 6A and 6B, the gaps PG vary in distance due to the difference in thickness of the recording media P. However, even though the thickness of the recording media P is the same, if the distance between the nozzle forming surface 22*a* and the support member 13 is changed, the gaps PG may vary as the same in distance.

In this manner, if the gap PG is large when ejecting the ink compared to a case where the gap PG is small, an amount of the generated ink mist is increased so that the amount of the ink that adheres to the nozzle forming surface 22*a* tends to be increased. In addition, according to the above-referenced reason, if the amount of the ink that adheres to the nozzle forming surface 22*a* is large compared to a case where the amount of the ink that adheres to the nozzle forming surface 22*a* is small, it is preferable that the sliding velocity VW of the wiping member 40 be lowered when wiping is carried out. Therefore, in the embodiment, the sliding velocity VW of the wiping member 40 in a case where the gap PG is large when ejecting the ink is lower than a case where the gap PG is small.

Next, referring to FIG. 7, an example of a relationship between the gap PG when ejecting the ink from the liquid ejecting head 22 and the sliding velocity VW when wiping is carried out thereafter will be described.

Figure 7:
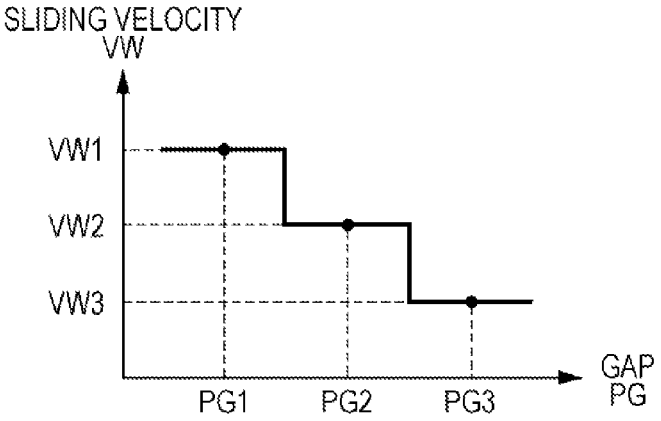
FIG. 7 is a graph illustrating a relationship between the gaps and a sliding velocity according to the first embodiment.

As illustrated in FIG. 7, in the embodiment, in accordance with the gap PG when ejecting the ink, the relative sliding velocity VW (VW1, VW2, VW3) between the liquid ejecting head 22 and the wiping member 40 when wiping is carried out after an ejection of the ink is selected from three stages. That is, the sliding velocity VW1 when wiping is carried out after the ejection of the ink at the smallest gap PG1 is higher than the sliding velocities VW2 and VW3 when wiping is carried out after the ejection of the ink at the gaps PG2 and PG3 that are larger than the gap PG1. In addition, the sliding velocity VW3 when wiping is carried out after the ejection of the ink at the largest gap PG3 is lower than the sliding velocities VW1 and VW2 when wiping is carried out after the ejection of the ink at the gaps PG1 and PG2 that are smaller than the gap PG3.

In the embodiment, the gap PG1 is an example of a first distance, and the gaps PG2 and PG3 are examples of a second distance that is longer than the first distance.

Next, an operation of the printer 11 of the first embodiment will be described.

If printing of an image and the like on the recording medium P ends by ejecting the ink from the nozzles 24 of the liquid ejecting head 22, in order to remove the ink that adheres to the nozzle forming surface 22*a* in accordance with the printing operation, wiping is carried out in which the wiping member 40 slides on the liquid ejecting head 22. When wiping is carried out, first, the wiper holder 31 is in a state of being moved to a wiping start position illustrated in FIG. 3, and then, the carriage 17 is moved to a home position HP. Subsequently, the wiper holder 31 is moved from the wiping start position in the wiping direction to carry out wiping.

Figure 8A:
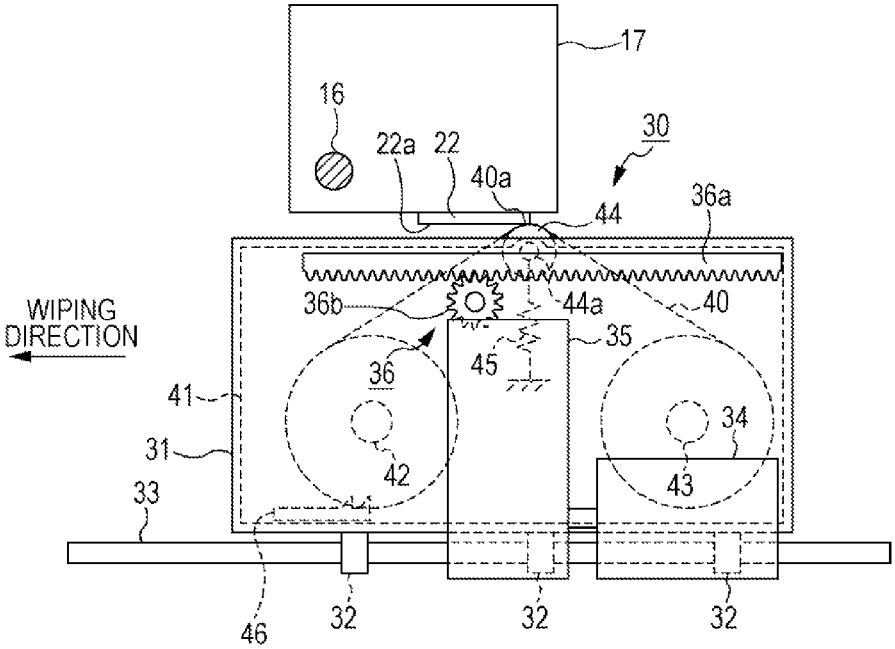
FIGS. 8A and 8B are schematic diagrams describing wiping operations according to the first embodiment.

As illustrated in FIG. 8A, if the drive motor 34 is driven in a normal rotation manner, the drive force is transmitted to the rack 36*a* via the power transmission mechanism 35 and the pinion 36*b* so that the wiper holder 31 moves in the wiping direction together with the rack 36*a*. Here, the wiping member 40 is in a state of being abutted on an end portion of the nozzle forming surface 22*a*, and the pressing roller 44 biased by the compression spring 45 causes the wiping member to be in a state of being pressed against the nozzle forming surface 22*a*.

Figure 8B:
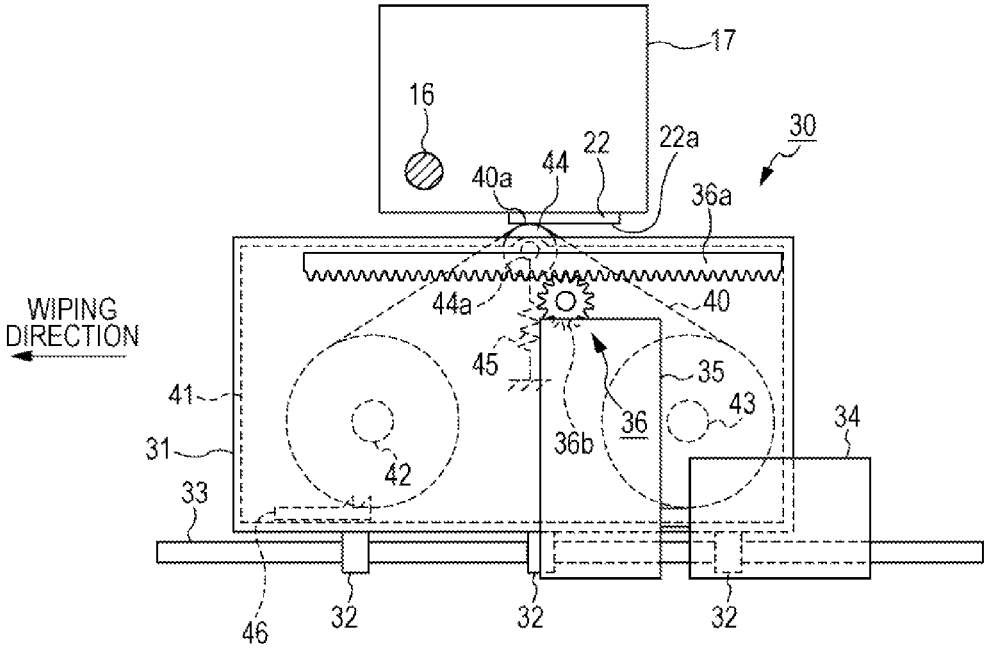

As illustrated in FIG. 8B, the wiping member 40 is in a state of being pressed against the nozzle forming surface 22*a*, and the wiper holder 31 moves in the wiping direction, thereby carrying out wiping in which the wiping member 40 slides on the nozzle forming surface 22*a*.

If the gap PG is the smallest gap PG1 when ejecting the ink before wiping is carried out, the wiper holder 31 moves at a comparatively high velocity (sliding velocity VW1), and thus, the wiping member 40 slides on the nozzle forming surface 22*a* at the sliding velocity VW1. Meanwhile, if the gap PG is the largest gap PG3 when ejecting the ink before wiping is carried out, the wiper holder 31 moves at a comparatively low velocity (sliding velocity VW3), and thus, the wiping member 40 slides on the nozzle forming surface 22*a* at the sliding velocity VW3. That is, when an amount of the ink that adheres to the nozzle forming surface 22*a* of the liquid ejecting head 22 is expected to be large, wiping is carried out at a low velocity. If the gap PG is the gap PG2 when ejecting the ink before wiping is carried out, the wiping member 40 slides on the nozzle forming surface 22*a* at the sliding velocity VW2 between the sliding velocity VW1 and the sliding velocity VW3.

In this manner, as illustrated in FIG. 5, before the primary absorption section 40*a* that is the slide section on the nozzle forming surface 22*a* absorbs the ink to the saturation point, the ink likely spreads from the primary absorption section 40*a* to the secondary absorption sections 40*b* that are the non-slide sections on the nozzle forming surface 22*a*. Therefore, the nozzle forming surface 22*a* being wiped out with the primary absorption section 40*a* in a state of absorbing the ink to the saturation point is suppressed. That is, even though an amount of the ink that adheres to the nozzle forming surface 22*a* is large, the ink or a foreign substance in the ink being pushed into the nozzles 24 is suppressed when the wiping member 40 (primary absorption section 40*a*) carries out wiping.

When wiping is carried out, a friction force in accordance with sliding on the nozzle forming surface 22*a* acts on the wiping member 40 (primary absorption section 40*a*) in an opposite direction of the wiping direction. The friction force acts in a direction of feeding the wiping member 40 that is wound to the feeding roller 42. However, the ratchet 46 regulates rotations of the feeding roller 42, thereby suppressing the wiping member 40 to be fed.

If the wiper holder 31 moves to the wiping end position, a regulation by the ratchet 46 upon the rotations of the feeding roller 42 is released such that the winding roller 43 rotates by a drive force that is transmitted from the drive motor 34 via the power transmission mechanism 35. Accordingly, a section of the wiping member 40 where the ink is yet to be absorbed is fed from the feeding roller 42 while a section of the wiping member 40 where the ink is already absorbed is wound up to the winding roller 43. Subsequently, after the carriage 17 returns from the home position HP to a recording region, the drive motor 34 is driven in a reversely rotating manner such that the wiper holder 31 moves from the wiping end position to the wiping start position. In this manner, the maintenance of the liquid ejecting head 22 by the wiper unit 30 is completed.

According to the first embodiment referenced above, it is possible to achieve below-described effects.

(1) The relative sliding velocity VW between the liquid ejecting head 22 and the wiping member 40 is lower when wiping is carried out in a case where the gap PG is large at the time of an ink ejection compared to a case where the gap PG is small. That is, the relative sliding velocity VW between the nozzle forming surface 22*a* and the wiping member 40 is lower when wiping is carried out in a case where an amount of the ink that adheres to the nozzle forming surface 22*a* of the liquid ejecting head 22 is expected to be large compared to a case where the amount is expected to be small. Therefore, even though a large amount of the ink adheres to the nozzle forming surface 22*a* of the liquid ejecting head 22, the ink that is absorbed from the nozzle forming surface 22*a* likely spreads in the wiping member 40 from the primary absorption section 40*a* that is the slide section with respect to the nozzle forming surface 22*a* to the secondary absorption sections 40*b* that are the non-slide sections. That is, even though an amount of the ink that adheres to the nozzle forming surface 22*a* is large, it is possible to suppress the wiping member 40 that pushes the ink or the foreign substance in the ink into the nozzles 24 when wiping is carried out. Accordingly, it is possible to wipe out the ink regardless of the amount of the ink that adheres to the nozzle forming surface 22*a* of the liquid ejecting head 22 so that the liquid ejection characteristic can be preferably maintained.

(2) On the other hand, the relative sliding velocity VW between the liquid ejecting head 22 and the wiping member 40 is higher when wiping is carried out in a case where the gap PG is small at the time of the ink ejection compared to a case where the gap PG is large. That is, the relative sliding velocity VW between the nozzle forming surface 22*a* and the wiping member 40 is higher when wiping is carried out in a case where an amount of the ink that adheres to the nozzle forming surface 22*a* of the liquid ejecting head 22 is expected to be small compared to a case where the amount is expected to be large. Therefore, if only a small amount of the ink adheres to the nozzle forming surface 22*a* of the liquid ejecting head 22, it is possible to reduce time for wiping.

Second Embodiment

Next, a second embodiment in which a liquid ejecting apparatus is embodied in an ink jet-type printer will be described with reference to drawings.

The second embodiment greatly differs from the first embodiment in an aspect where wiping is carried out by relatively moving the carriage 17 with respect to a fixedly disposed wiper holder 31 and an aspect where winding of the wiping member 40 is carried out during the wiping. In describing the second embodiment hereafter, the same reference numerals will be applied to the same configuration elements as in the first embodiment, and the descriptions thereof will not be repeated.

Figure 9:
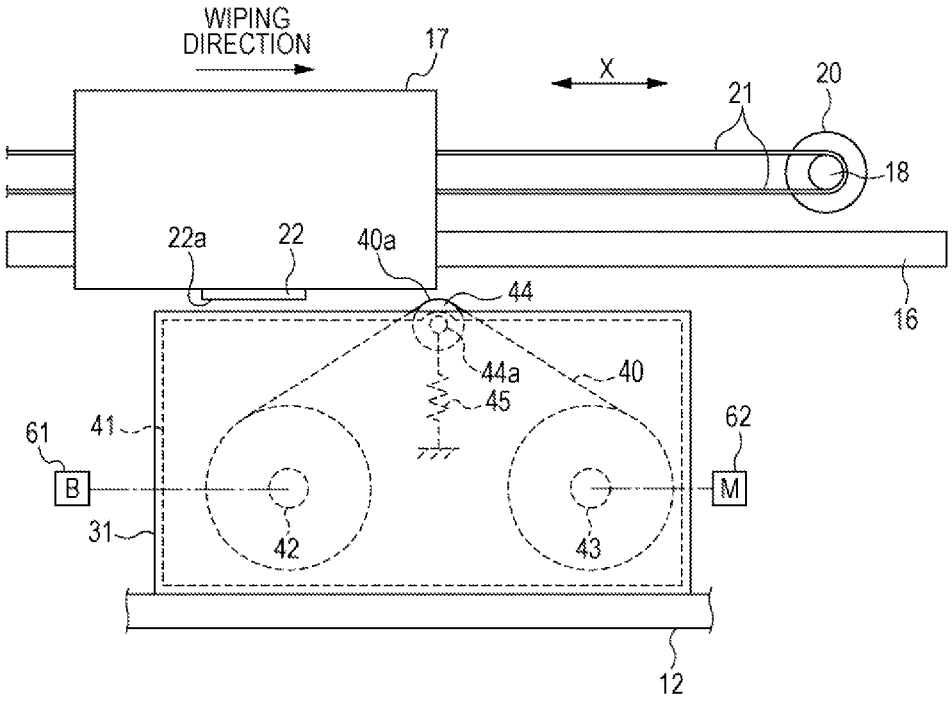
FIG. 9 is a front view illustrating a schematic configuration of the wiper unit according to a second embodiment.

As illustrated in FIG. 9, the wiper unit 30 of the second embodiment includes the wiper holder 31 that is fixedly disposed in the frame 12 of the printer 11 and the wiper cassette 41 that is installed in the wiper holder 31 in an attachable and detachable manner. The wiper holder 31 is disposed in the longitudinal direction thereof as the main scanning direction X.

The feeding roller 42 of the wiper cassette 41 is provided with a brake device 61 that regulates and allows the roller 42 not to rotate or to rotate in a direction of feeding the wiping member 40 (clockwise direction in FIG. 9). The brake device 61 is connected to the input/output interface of the control portion 50. The control portion 50 is capable of adjusting a degree in the braking force that is applied to the feeding roller 42 by the brake device 61.

Meanwhile, the winding roller 43 of the wiper cassette 41 is connected to a winding motor 62 that rotates the winding roller 43 in a direction in which the wiping member 40 is wound (clockwise direction in FIG. 9). The winding motor 62 is connected to the input/output interface of the control portion 50 and the control portion 50 is capable of changing an amount of rotation of the winding motor 62.

In addition, the axis line directions in the respective rollers 42, 43 and 44 which are pivotally supported by the wiper cassette 41 in a state where the wiper cassette 41 is installed on the wiper holder 31 are a direction along the transportation direction Y. In the wiper unit 30 of the embodiment, the relative moving direction (wiping direction) of the liquid ejecting head 22 and the wiping member 40 when wiping is carried out is a direction that is orthogonal to a forming direction of each nozzle row 25 of the liquid ejecting head 22, that is, the main scanning direction X.

In addition, in the embodiment, since wiping is carried out by relatively moving the carriage 17 with respect to the fixedly disposed wiper holder 31, by the pulleys 18 and 19, the carriage motor 20 and the timing belt 21, there is configured the "movement mechanism" that relatively moves the liquid ejecting head 22 and the wiping member 40 when wiping is carried out including the drive motor 34, the power transmission mechanism 35 and the rack-and-pinion mechanism 36.

As described with reference to FIG. 5, if an amount of the ink that adheres to the nozzle forming surface 22*a* is large, it is preferable to cause the primary absorption section 40*a* where the ink is already absorbed to be the primary absorption section 40*a* where the ink is yet to be absorbed by lowering the sliding velocity VW when wiping is carried out or winding the wiping member 40 during the wiping.

Therefore, in the embodiment, if the gap PG is large when ejecting the ink, the wiping member 40 is wounded from the feeding roller 42 to the winding roller 43 by not only carrying out wiping at a low velocity but also rotating the winding roller 43 in the winding direction. In addition, if the gap PG is larger when ejecting the ink, a winding amount QW of the wiping member 40 is increased when wiping is carried out. In the embodiment, the winding amount QW of the wiping member 40 when wiping is carried out may be calculated, for example, in accordance with a detected value by detecting an amount of rotation of the pressing roller 44 using a rotation amount detector such as a rotary encoder.

Figure 10A:
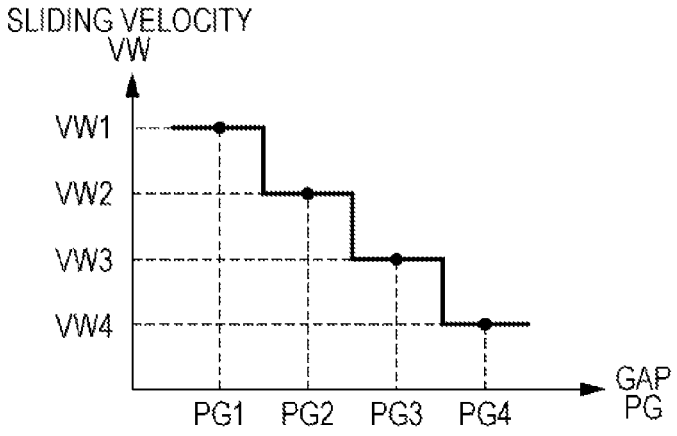
FIG. 10A is a graph illustrating a relationship between the gaps and the sliding velocities according to the second embodiment.

As illustrated in FIG. 10A, in the embodiment, in accordance with the gap PG when ejecting the ink, the sliding velocity VW (VW1, VW2, VW3, VW4) when wiping is carried out after an ejection of the ink can be selected from four stages. In this case, the sliding velocity VW1 when wiping is carried out after the ejection of the ink at the smallest gap PG1 is higher than the sliding velocities VW2, VW3 and VW4 when wiping is carried out after the ejection of the ink at the gaps PG2, PG3 and PG4 that are larger than the gap PG1. In addition, the sliding velocity VW4 when wiping is carried out after the ejection of the ink at the largest gap PG4 is lower than the sliding velocities VW1, VW2 and VW3 when wiping is carried out after the ejection of the ink at the gaps PG1, PG2 and PG3 that are smaller than the gap PG4.

Figure 10B:
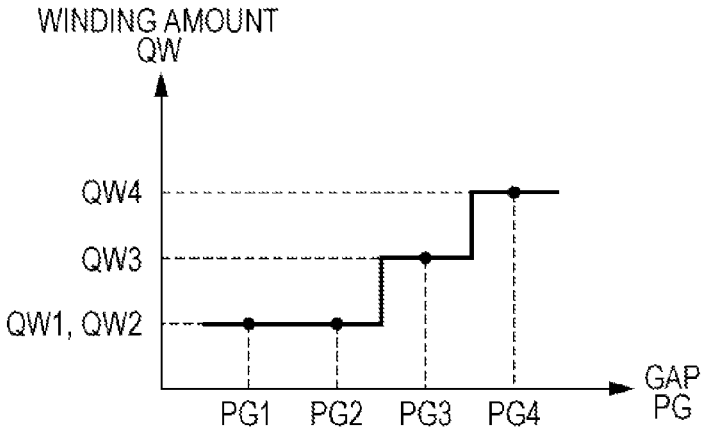
FIG. 10B is a graph illustrating a relationship between the gaps and winding amounts of the wiping member according to the second embodiment.

In addition, as illustrated in FIG. 10B, in the embodiment, in accordance with the gap PG when ejecting the ink, the winding amount QW (QW1, QW2, QW3, QW4) of the wiping member 40 when wiping is carried out after an ejection of the ink can be selected from four stages. In the embodiment, since both of the winding amount QW1 corresponding to the gap PG1 and the winding amount QW2 corresponding to the gap PG2 are "0 (zero)", the winding amount QW of the winding roller 43 is selected from three stages ("0 (zero)", QW3, QW4).

As illustrated in FIG. 10B, when wiping is carried out after the ejection of the ink at the smallest gap PG1 and the second smallest gap PG2, winding of the wiping member 40 is not carried out (winding amount QW1=QW2="0 (zero)"). In addition, when the wiping is carried out after the ejection of the ink at the gaps PG3 and PG4 which are larger than the comparatively small gaps PG1 and PG2, the winding roller 43 is rotated in the winding direction, thereby carrying out winding of the wiping member 40 from the feeding roller 42 to the winding roller 43. Furthermore, the winding amount QW4 of the wiping member 40 when wiping is carried out after the ejection of the ink at the largest gap PG4 is larger than the winding amount QW3 of the wiping member 40 when wiping is carried out after the ejection of the ink at the gap PG3 that is smaller than the PG4.

In the embodiment, the gap PG1 is an example of the first distance, and the gaps PG2 is an example of the second distance that is longer than the first distance. The gaps PG3 is an example of the third distance that is longer than the first distance, and the gaps PG4 is an example of the fourth distance that is longer than the third distance.

Next, an operation of the printer 11 of the second embodiment will be described.

In the embodiment, when wiping is carried out, the carriage motor 20 is driven so as to move the carriage 17 from a recording region facing the recording medium P to the home position HP as illustrated in FIG. 9. The carriage 17 is moved from the aforementioned state in the wiping direction, thereby carrying out wiping in which the wiping member 40 slides on the nozzle forming surface 22*a* of the liquid ejecting head 22.

Figure 11A:
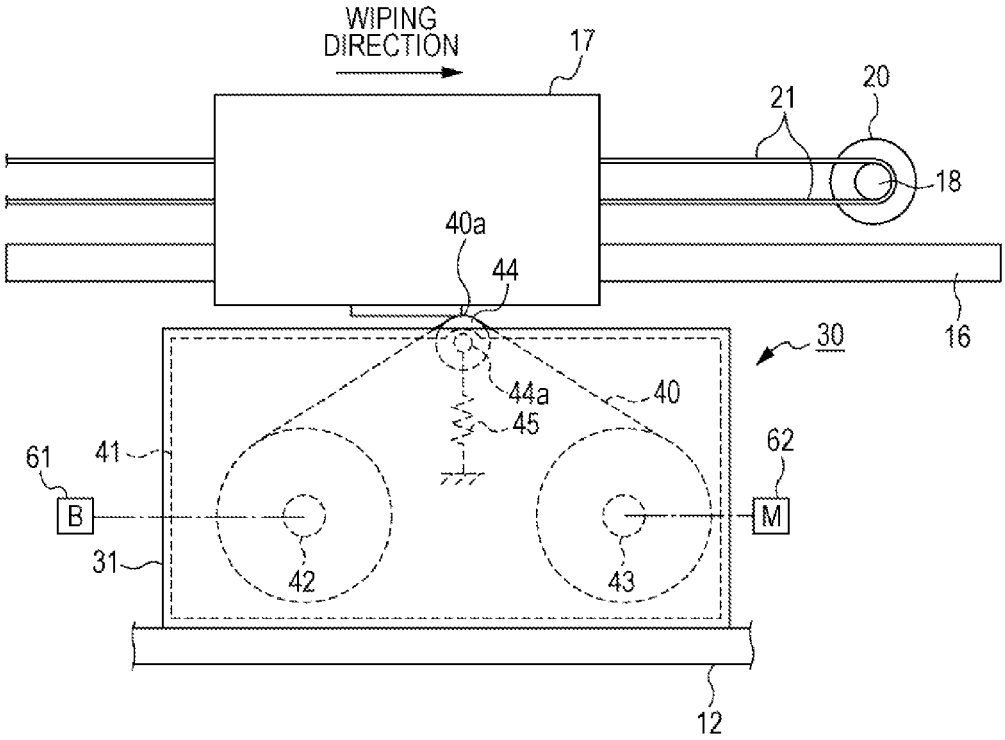
FIGS. 11A to 11C are schematic diagrams describing wiping operations according to the second embodiment.

As illustrated in FIG. 11A, if the carriage motor 20 is driven and the carriage 17 is moved in the wiping direction, an end portion of the nozzle forming surface 22*a* of the liquid ejecting head 22 that is supported by the carriage 17 abuts on the wiping member 40 (primary absorption section 40*a*). At this time, the wiping member 40 is in a state of being pressed against the nozzle forming surface 22*a* by the pressing roller 44 that is biased by the compression spring 45.

If the gap PG when ejecting the ink before wiping is carried out is the smallest gap PG1 and the second smallest gap PG2, in order to regulate feeding of the wiping member 40, the braking force is applied to the feeding roller 42 by the brake device 61. Subsequently, the carriage 17 moves in the wiping direction in a state where the braking force is applied to the feeding roller 42 so as to carry out wiping without feeding of the wiping member 40. That is, in accordance with a movement of the carriage 17 in the wiping direction, the wiping member 40 (primary absorption section 40*a*) slides on the nozzle forming surface 22*a* of the liquid ejecting head 22 that is supported by the carriage 17, thereby wiping the ink that adheres to the nozzle forming surface 22*a*.

In addition, a velocity of the moving carriage 17 in the aforementioned case becomes the sliding velocity VW1 if the gap PG is the smallest gap PG1 when ejecting the ink, and becomes the sliding velocity VW2 if the gap PG is the second smallest gap PG2. That is, if the amount of the ink that adheres to the nozzle forming surface 22*a* of the liquid ejecting head 22 is expected to be large, wiping is carried out at a low velocity. In addition, if the ink is ejected at the gaps PG1 and PG2, since the feeding of the wiping member 40 is regulated, both of the winding amounts QW1 and QW2 of the wiping member 40 are "0 (zero)".

Meanwhile, if the gap PG when ejecting the ink before wiping is carried out is the gaps PG3 and PG4 which are comparatively large, the sliding velocities VW3 and VW4 when wiping is carried out are lower than the sliding velocities VW1 and VW2 when wiping that is carried out after the ejection of the ink at the gaps PG1 and PG2 which are comparatively small. Furthermore, when wiping that is carried out after the ejection of the ink at the gaps PG3 and PG4, winding of the wiping member 40 is carried out during the wiping. Specifically, with respect to the wiping member 40, the winding motor 62 rotates the winding roller 43 at the same time when the carriage 17 moves in the wiping direction, thereby carrying out winding of the wiping member 40 from the feeding roller 42 to the winding roller 43.

Figure 11B:
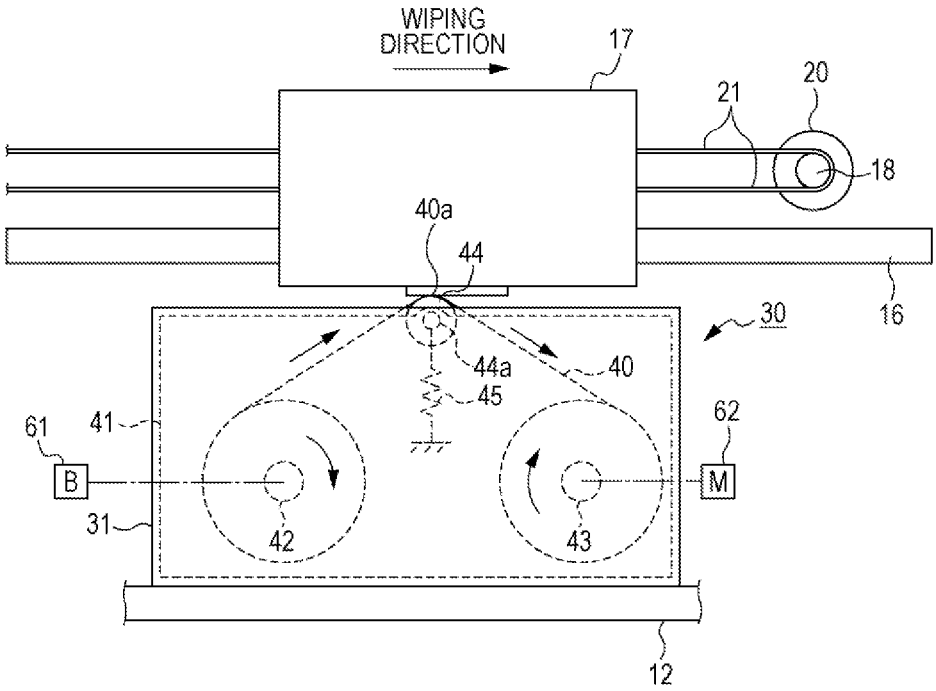

As illustrated in FIG. 11B, when wiping is carried out after the ejection of the ink at the gaps PG3 and PG4, the primary absorption section 40*a* of the wiping member 40 slides on the nozzle forming surface 22*a* while being replaced with a primary absorption section 40*a* where the ink is yet to be absorbed. Here, as illustrated with a bold line in FIG. 11B, during the wiping of the nozzle forming surface 22*a*, the wiping member 40 that absorbed the ink begins to be wound from the pressing roller 44 to the winding roller 43. That is, the ink is absorbed into the wiping member 40 in a wider area than the primary absorption section 40*a* being in abutment with the nozzle forming surface 22*a* at the beginning of wiping by carrying out winding of the wiping member 40.

Furthermore, in the winding amount QW of the wiping member 40 when wiping is carried out after the ejection of the ink at the gaps PG3 and PG4, the winding amount QW4 corresponding to the gap PG4 is larger than the winding amount QW3 corresponding to the gap PG3. Therefore, if the amount of the ink that adheres to the nozzle forming surface 22*a* is expected to be large from the gap PG when ejecting the ink, a larger amount of the wiping member 40 is wound so as to suppress sliding of the primary absorption section 40*a* where the ink is absorbed to the saturation point on the nozzle forming surface 22*a*. That is, when wiping is carried out, the wiping member 40 pushing the ink or the foreign substance in the ink into the nozzles 24 is suppressed.

When the wiping is carried out, in order to regulate feeding of the wiping member 40 in accordance with a slide on the nozzle forming surface 22*a* while allowing feeding of the wiping member 40 in accordance with rotations of the winding roller 43, the braking force is applied to the feeding roller 42 by the brake device 61. Therefore, the wiping member 40 being unwillingly fed due to the friction force applied by sliding of the nozzle forming surface 22*a* is suppressed. The braking force applied to the feeding roller 42 by the brake device 61 is greater than the friction force applied to the wiping member 40 in accordance with sliding of the nozzle forming surface 22*a*, and the braking force is smaller than a tensile force applied to the wiping member 40 by rotations of the winding roller 43.

Figure 11C:
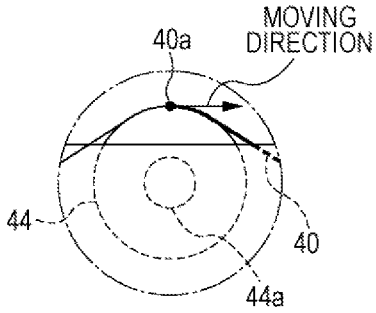

In addition, as illustrated in FIG. 11C, when wiping is carried out, a moving direction in which the primary absorption section 40*a* of the wiping member 40 that slides on the nozzle forming surface 22*a* moves in accordance with winding of the wiping member 40 is equal to the relative moving direction (wiping direction) of the liquid ejecting head 22 with respect to the wiper cassette 41. Therefore, the friction force generated in accordance with relative sliding between the nozzle forming surface 22*a* of the liquid ejecting head 22 and the wiping member 40 becomes small so that the friction force that acts on the nozzle forming surface 22*a* and the wiping member 40 is reduced.

If sliding of the wiping member 40 and the nozzle forming surface 22*a* ends by moving the carriage 17 further in the wiping direction, for example, the carriage 17 is caused to return to the recording region after the wiping member 40 is retracted downward or the like, thereby completing the maintenance of the liquid ejecting head 22 by the wiper unit 30.

According to the second embodiment described above, in addition to the effects (1) and (2) of the first embodiment, it is possible to achieve the below-described effects.

(3) If the gap PG when ejecting the ink is the gap PG3 that is larger than the smallest gap PG1, that is, if an amount of the ink that adheres to the nozzle forming surface 22*a* is expected to be large, winding of the wiping member 40 is carried out when wiping is carried out. Accordingly, if the gap PG when ejecting the ink is large, a contact area of the wiping member 40 (primary absorption section 40*a*) that slides on the nozzle forming surface 22*a* can be widened. Therefore, if a large amount of the ink adheres to the nozzle forming surface 22*a* due to the ejection of the ink at the comparatively large gaps PG3 and PG4, the ink ejection characteristic can be preferably maintained by wiping the ink appropriately.

(4) If the gap PG when ejecting the ink is the largest gap PG4, that is, if an amount of the ink that adheres to the nozzle forming surface 22*a* is expected to be larger, the winding amount QW of the wiping member 40 is increased when wiping is carried out. Accordingly, if the gap PG is large, the contact area of the wiping member 40 (primary absorption section 40*a*) that slides on the nozzle forming surface 22*a* can be further widened. Therefore, if a larger amount of the ink adheres to the nozzle forming surface 22*a* due to the ejection of the ink at a larger gap PG, the ink ejection characteristic can be preferably maintained by wiping the ink appropriately.

(5) When wiping is carried out, a moving direction in which the primary absorption section 40*a* of the wiping member 40 moves in accordance with winding of the wiping member 40 becomes the relative moving direction (wiping direction) of the liquid ejecting head 22 with respect to the wiper cassette 41. Therefore, the friction force that acts against the nozzle forming surface 22*a* in accordance with sliding of the wiping member 40 can be reduced compared to a case where the moving direction is a reversed direction.

The embodiments may be changed as below.

In the first embodiment, the wiping member 40 may be wound when wiping is carried out as that of the second embodiment. In this case, it is preferable to include a configuration corresponding to the brake device 61 and the winding motor 62 of the second embodiment.

In the first embodiment, the wiping member 40 may not be long. In this case, it is preferable that the secondary absorption section 40*b* be provided in the wiping member 40 so as to be able to spread the ink from the primary absorption section 40*a*.

In the first embodiment, wiping may be carried out by fixing the wiper holder 31 and the wiper cassette 41 and moving the pressing roller 44 only in the wiping direction.

In the second embodiment, the wiping member 40 may be wound when wiping is carried out after the ejection of the ink at the comparatively small gaps PG1 and PG2. Accordingly, it is possible to reduce the time for wiping by carrying out wiping at a higher sliding velocity VW than the sliding velocity VW1 and VW2 corresponding to the gaps PG1 and PG2.

In the second embodiment, the sliding velocities VW3 and VW4 corresponding to the comparatively large gaps PG3 and PG4 may be the same velocity with each other.

In the second embodiment, in the sliding velocities VW3 and VW4 and the winding amounts QW3 and QW4 corresponding to the comparatively large gaps PG3 and PG4, the sliding velocities VW3 and VW4 may be further speeded up by further increasing the winding amounts QW3 and QW4.

For example, when wiping is carried out after the ejection of the ink at the gap PG3, wiping may be carried out at a sliding velocity VW3F that is higher than the sliding velocity VW3 corresponding to the gap PG3 and at a winding amount QW3F that is larger than the winding amount QW3 corresponding to the gap PG3. In this case, it is preferable that the sliding velocities VW3 and VW3F and the winding amounts QW3 and QW3F satisfy the following expression (Expression 1).

$$VW3 \cdot QW3F = VW3F \cdot QW3 \qquad \text{Expression 1}$$

The above-referenced expression (Expression 1) denotes that if the winding amount QW of the wiping member 40 when carrying out wiping is increased, the sliding velocity VW may be increased. Accordingly, it is possible to reduce the time for wiping by increasing the winding amount QW of the wiping member 40 and reduce the winding amount QW of the wiping member 40 by lowering the sliding velocity VW.

In the second embodiment, when wiping is carried out after the ejection of the ink at the comparatively large gaps PG3 and PG4, the winding amount QW of the wiping member 40 may be set to cause a moving velocity of the liquid ejecting head 22 in the wiping direction and a moving velocity of the primary absorption section 40*a* of the wiping member 40 to be substantially equal velocity.

In the second embodiment, a motor that is the same as the winding motor 62 in place of the brake device 61 may be disposed.

In each embodiment, a relative sliding direction of the nozzle forming surface 22*a* and the wiping member 40 when wiping is carried out may be any direction as long as the direction is along the nozzle forming surface 22*a*.

In each embodiment, the sliding velocity VW illustrated in FIGS. 7 and 10A may be set in accordance with the gap PG of two stages or may be set in accordance with the gap PG of four or more stages. Otherwise, lengths of the gap PG may be, for example, in a successive relationship such as a linear relationship. In the second embodiment, the same can be applied to the winding amount QW illustrated in FIG. 10B.

In each embodiment, as long as the wiping member 40 is capable of absorbing the ink (liquid), the wiping member may be a woven fabric of synthetic fibers and may be a woven fabric or non-woven fabric of natural fibers.

In each embodiment, the liquid ejecting apparatus may be a liquid ejecting apparatus that ejects or discharges other liquids in addition to the ink. A state of the liquid that is discharged as a liquid droplet in a minute amount from the liquid ejecting apparatus includes a granular state, a tear state and a threadlike state which leaves a trail. In addition, the above-referenced liquid may be any material that can be ejected from the liquid ejecting apparatus. For example, the liquid may be any substance as long as the substance is in a state of a liquid phase. The substance includes a liquid body with high or low viscosity and a fluidal body such as a sol, gel water, other inorganic solvent, an organic solvent, a solution, a liquid resin and a liquid metal (metallic melt). In addition to a liquid as a state of a substance, the liquid includes substances in which particles of a functional material made of a solid body such as a pigment or a metal particle are melted, dispersed or mixed. As a representative example of the liquid, an ink that is described in the embodiment or a liquid crystal can be exemplified. Here, the ink includes various liquid compositions such as ordinary water-based ink and solvent ink, a gel ink, a hot melt ink. As a specific example of the liquid ejecting apparatus, for example, there is a liquid ejecting apparatus that ejects a liquid including an electrode material employed in manufacturing of a liquid crystal display, an electroluminescence (EL) display, a surface lighting display and a color filter or a material such as a coloring material in a state of dispersed or fused. In addition, the apparatus may be a liquid ejecting apparatus that ejects a bio organic substance employed in manufacturing of a bio chip, a liquid ejecting apparatus that ejects a liquid of a sample employed as a precision pipette, and a printing device, a micro dispenser or the like. Furthermore, the apparatus may be a liquid ejecting apparatus that ejects a lubricant to a precision machine such as a timepiece and a camera in a pinpoint, and the apparatus may be a liquid ejecting apparatus that ejects a transparent resin liquid such as an ultraviolet curing resin onto a substrate to form a micro hemisphere lens (optical lens) and the like employed in an optical communication element and the like. In addition, the apparatus may be a liquid ejecting apparatus that ejects an etching liquid such as an acid or an alkaline for etching of a substrate and the like.

Next, technical ideas that can be understood from the above-referenced embodiments and other embodiments will be added below.

(A) It is preferable that the liquid ejecting apparatus further include a wiper cassette that holds the wiping member. It is preferable that the wiping member be formed in a long shape to be configured to move relatively with the liquid ejecting head in a state of being held by the wiper cassette. It is preferable that the wiper cassette rotatably support the first roller that winds an end of the wiping member in the longitudinal direction, the second roller that winds the other end of the wiping member in the longitudinal direction, and the third roller that presses the wiping member against the nozzle forming surface. It is preferable that the control portion rotate the second roller in a winding direction to cause the wiping member to be wound from the first roller to the second roller when wiping is carried out.

(B) In the above-referenced liquid ejecting apparatus, it is preferable that the control portion cause the winding amount of the wiping member to be increased as the moving velocity becomes high when wiping is carried out.

The entire disclosure of Japanese Patent Application No. 2013-003671, filed Jan. 11, 2013 is expressly incorporated by reference herein.

What is claimed is:

1. A liquid ejecting apparatus comprising:

a liquid ejecting head that ejects a liquid from a nozzle toward a target which is positioned away from a nozzle forming surface where the nozzle is formed;

a wiping member that is capable of wiping the nozzle forming surface;

a movement mechanism that relatively moves the liquid ejecting head and the wiping member when wiping is carried out; and a control portion that estimates an amount of the liquid that adheres to the nozzle forming surface on a basis of a distance between the nozzle forming surface and the target when the liquid is ejected from the nozzle toward the target and that controls the movement mechanism so as to cause a relative moving velocity between the liquid ejecting head and the wiping member to be lower when wiping is carried out in a case where the liquid is ejected at a second distance of which an opposing distance between the nozzle forming surface and the target is longer than a first distance compared to a case where the liquid is ejected at the first distance of the opposing distance.

2. The liquid ejecting apparatus according to claim 1, further comprising:

a wiper unit that holds the wiping member, wherein the wiping member is formed in a long shape to be configured to move relatively with the liquid ejecting head in a state of being held by the wiper cassette, the wiper unit rotatably supports a first roller that winds an end of the wiping member in the longitudinal direction, a second roller that winds the other end of the wiping member in the longitudinal direction, and a third roller that presses the wiping member against the nozzle forming surface, and the control portion rotates the second roller in a winding direction to cause the wiping member to be wound from the first roller to the second roller when wiping is carried out in a case where the liquid is ejected at a third distance of which the opposing distance is longer than the first distance.

3. The liquid ejecting apparatus according to claim 2, wherein the control portion causes a winding amount of the wiping member to be larger when wiping is carried out in a case where the liquid is ejected at a fourth distance of which the opposing distance is longer than a third distance compared to a case where the liquid is ejected at the third distance of the opposing distance.

4. The liquid ejecting apparatus according to claim 3, wherein when wiping is carried out, a moving direction in which a slide section of the wiping member that slides on the nozzle forming surface moves in accordance with winding of the wiping member is equal to a relative moving direction of the liquid ejecting head with respect to the third roller of the wiper unit.

5. A maintenance method of wiping out a liquid from a nozzle forming surface by relatively moving a wiping member capable of wiping the nozzle forming surface and a liquid ejecting head after the liquid is ejected from a nozzle toward a target that is positioned away from the nozzle forming surface where the nozzle is formed in the liquid ejecting head, the method comprising:

estimating an amount of the liquid that adheres to the nozzle forming surface on a basis of a distance between the nozzle forming surface and the target when the liquid is ejected from the nozzle toward the target; and causing a relative moving velocity between the liquid ejecting head and the wiping member to be lower when wiping is carried out in a case where the liquid is ejected at a second distance of which an opposing distance between the nozzle forming surface and the target is longer than a first distance compared to a case where the liquid is ejected at the first distance of the opposing distance.

6. The maintenance method according to claim 5, wherein the step of estimating the amount of the liquid that adheres to the nozzle forming surface increases as the distance between the nozzle forming surface and the target increases.

* * * * *